US006295813B1

(12) United States Patent
Stenquist

(10) Patent No.: US 6,295,813 B1
(45) Date of Patent: Oct. 2, 2001

(54) PRESS DRIVEN TOOL ACTUATOR MODULE

(75) Inventor: Sven Stenquist, Bodafors (SE)

(73) Assignee: Diebolt International, Inc., Plymouth, MI (US)

( * ) Notice: Subject to any disclaimer, the term of this patent is extended or adjusted under 35 U.S.C. 154(b) by 0 days.

(21) Appl. No.: 09/325,090

(22) Filed: Jun. 3, 1999

Related U.S. Application Data

(63) Continuation-in-part of application No. 08/976,775, filed on Nov. 24, 1997.

(51) Int. Cl.[7] ..... F15B 7/04
(52) U.S. Cl. ..... 60/574; 92/52
(58) Field of Search ..... 60/574, 592, 533; 91/169, 4 R; 92/52, 134, 161; 100/266, 269.14, 269.18; 138/30, 31

(56) References Cited

U.S. PATENT DOCUMENTS 2,786,409 * 3/1957 Claire ..... 100/266
5,303,906 4/1994 Cotter et al. .
5,606,910 3/1997 Katz .

* cited by examiner

*Primary Examiner*—Edward K. Look
*Assistant Examiner*—Thomas E. Lazo
(74) *Attorney, Agent, or Firm*—Reising, Ethington, Barnes, Kisselle, Learman & McCulloch, P.C.

(57) ABSTRACT

For a hydraulically actuated device a hydraulic power cylinder with an actuator slidably received for reciprocation within the cylinder and a piston slidably received for reciprocation within a sleeve of the actuator and defining a gas chamber on one side of the piston and a hydraulic fluid chamber on the other side of the piston so that the maximum pressure in the hydraulic fluid chamber is limited as a function of the force of compressed gas in the gas chamber acting on the piston. In this way, the maximum system pressure is a function of and substantially corresponds to the pressure of the compressed gas within the gas chamber and acting on the piston. Desirably, the pressure of the compressed gas in the gas chamber can be readily changed to change the maximum hydraulic fluid pressure.

14 Claims, 4 Drawing Sheets

PRESS DRIVEN TOOL ACTUATOR MODULE

REFERENCE TO RELATED APPLICATION

This application is a continuation-in-part of copending application Ser. No. 08/976,775 filed Nov. 24, 1997 entitled Press Driven Tool Actuator Module.

FIELD OF THE INVENTION

This invention relates generally to fluid actuated cylinders and more particularly to an actuator for fluid actuated cylinders.

BACKGROUND OF THE INVENTION

Press driven tool modules utilizing fluid actuated cylinders have found acceptance due to their adaptability to conventional presses wherein a vertical force input by a press ram to one fluid power cylinder actuates a second fluid work cylinder to provide a horizontal or otherwise directed force output to actuate a tool to form a portion of a workpiece inclined to the axis of the press ram. This design is flexible in that various tool modules can be used with the same press to provided a number of forming operations actuated by a single press. One such press driven fluid actuated tool module is disclosed in U.S. Pat. No. 5,606,910. In this system a press ram displaces a piston of a hydraulic power cylinder to pressurize the hydraulic fluid and thereby displace a piston of a work cylinder which has a tool mounted thereon to engage the tool with the workpiece. The power cylinder has an upper reservoir containing a reserve supply of hydraulic fluid which when the piston is retracted communicates with a lower portion of the cylinder, which contains the hydraulic fluid to be pressurized by displacement of the piston, after it engages with a high pressure seal to prohibit pressurized fluid from flowing into the upper reservoir. The power cylinder must be disposed in substantially vertically upright position to function properly. When the high pressure seal wears, there is, at the very least, a loss in pressure of the hydraulic fluid when the work cylinder piston is displaced which reduces the efficiency of the system and effects the performance of the work tool in use. Further, wear on the seal can lead to failure of the power cylinder requiring replacement of the entire power cylinder or at least the high pressure seal resulting in increased down time for the system.

SUMMARY OF THE INVENTION

For a hydraulically actuated device a hydraulic power cylinder with an actuator slidably received for reciprocation within the cylinder and a piston slidably received for reciprocation within the actuator and defining in part a gas chamber on one side of the piston and a hydraulic fluid chamber on the other side of the piston so that the maximum pressure in the hydraulic fluid chamber is limited as a function of the pressure of gas in the gas chamber acting on the piston. In this way, the maximum system pressure corresponds to the pressure of the gas within the gas chamber acting on the piston. Desirably, the pressure within the gas chamber can be readily changed to change the maximum hydraulic fluid pressure.

In one form, the hydraulic actuator is used to drive a work cylinder having a work tool to form a workpiece adjacent the work cylinder. Preferably, a press displaces the actuator to decrease the volume of the hydraulic chamber and force hydraulic fluid under pressure from the hydraulic actuator to the work cylinder to drive a piston and rod of the work cylinder to displace the associated work tool to form the workpiece. A biasing member in the work cylinder acting on its rod and piston returns the hydraulic actuator to its unloaded position when the press ram is retracted from the actuator. The biasing member may be one or more gas springs carried by the work cylinder.

Objects, features and advantages of this invention include providing a hydraulic actuator which limits the maximum pressure within the hydraulic actuator and within a device driven by the hydraulic actuator, is readily adaptable to many hydraulic cylinder applications, enables the maximum hydraulic fluid pressure to be readily varied, improves the in-service useful life of the high pressure seals, is reliable durable, of relatively simple design and economical manufacture, and has a long useful life in service.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENTS

Figure 1:
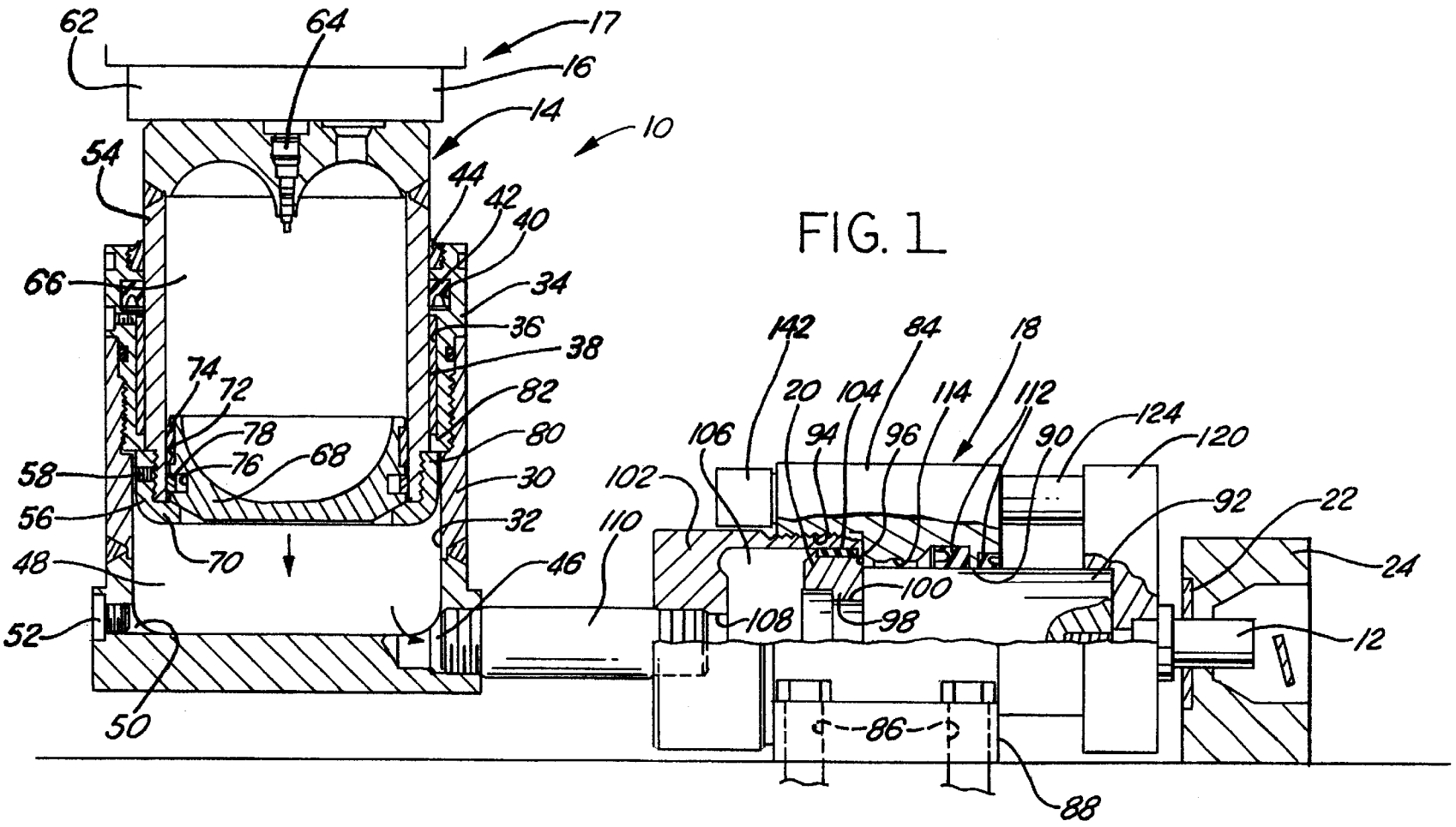
FIG. 1 is a sectional view of a work cylinder and a hydraulic actuator according to the invention.

Referring in more detail to the drawings, FIG. 1 illustrates a hydraulic actuator 10 for a hydraulically driven work tool 12 and having an actuator 14 displaceable by a ram 16 of a press 17 to pressurize hydraulic fluid in the actuator 10 and deliver it to a work cylinder 18 to drive a work cylinder piston 20 to advance the work tool 12 along its axis to punch a hole in or form a workpiece 22 received on a carrier 24. After the forming operation is complete, the press ram 16 is retracted or withdrawn and the actuator 14 is returned to its retracted position by a biasing means, such as a spring or a gas spring carried by the work cylinder 18 and constructed and arranged to cause the work cylinder piston 20 to return it to its retracted position and displace the hydraulic fluid back into the actuator 10 thereby displacing the actuator 14 to its retracted position. With the system reset in its starting position, a subsequent cycle of the hydraulic actuator 10 and the work tool 12 can be performed to form another workpiece 22.

Figure 2:
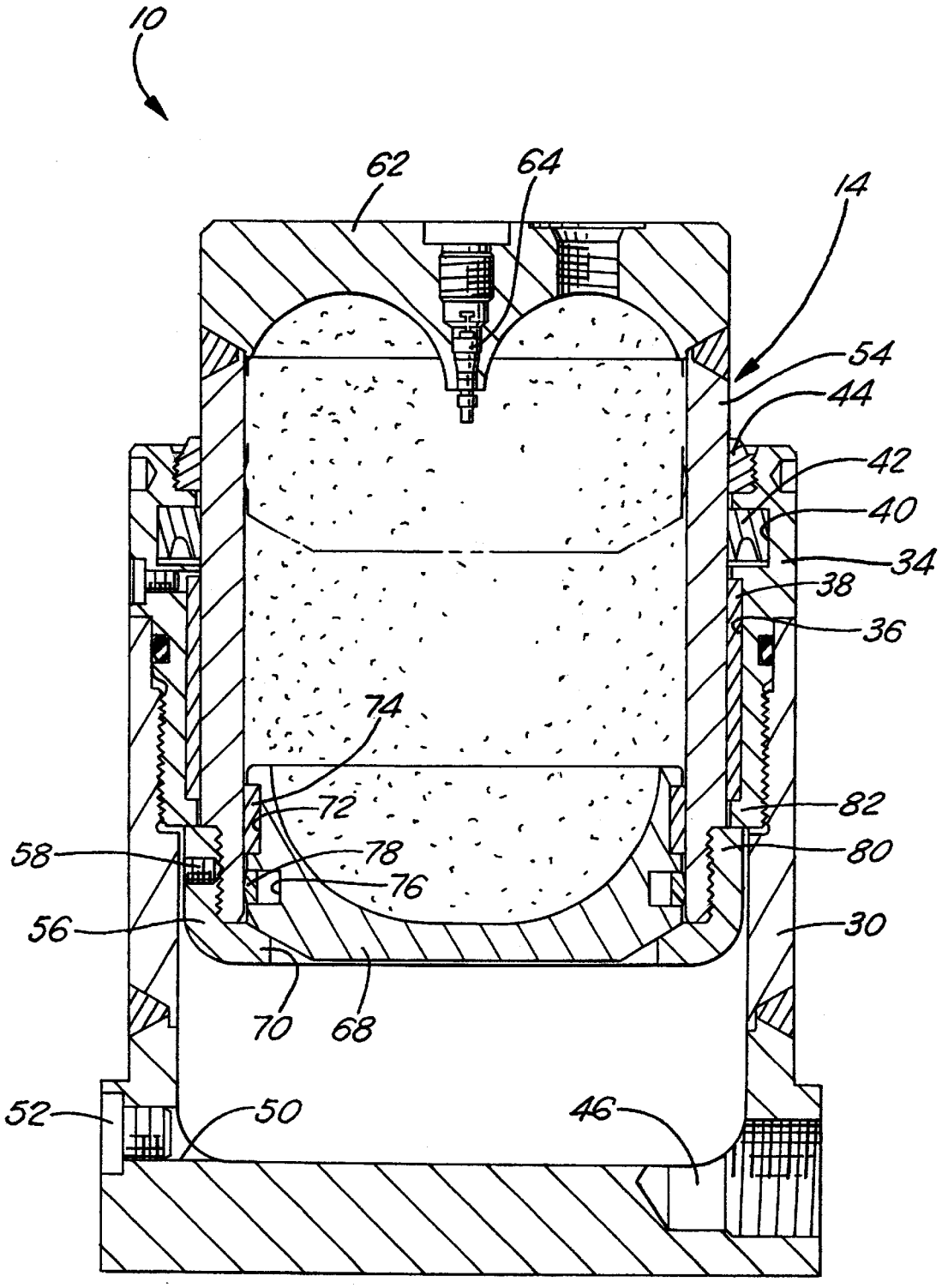
FIG. 2 is a sectional view of the hydraulic actuator of FIG. 1.

As best shown in FIGS. 1 and 2, the hydraulic actuator 10 has a cylinder body 30 with a stepped, generally cylindrical bore 32 in which the actuator 14 is slidably received for reciprocation between advanced and retracted positions. An annular bearing retainer 34 is threadably received in the bore 32 and has a first annular groove 36 in which an annular bearing 38 is received and a second annular groove 40 in which a seal ring 42 is received. A wiper 44 may also be carried by the retainer 34. An outlet 46 through the cylinder body 30 communicates a hydraulic fluid chamber 48 with the work cylinder 18. An opening 50 through the cylinder body 30 may be used to add hydraulic fluid to or remove hydraulic fluid from the chamber 48 and in use is closed by a plug 52.

The actuator 14 has a cylindrical sleeve 54 threadably attached to an annular retainer 56 with one or more set screws 58 received through openings in the retainer 56 to fix its position relative to the sleeve 54. A cap 62 closes the upper end of the sleeve 54 and is preferably welded or otherwise attached and sealed to the sleeve 54 and preferably has a gas filler valve 64 extending therethrough to permit pressurized gas to be added to or removed from a gas chamber 66. The gas chamber 66 is defined in part by a piston 68 slidably received within the sleeve 54 and retained therein by an inwardly extending edge 70 of the retainer 56. The piston 68 has a first annular groove 72 which receives an annular bearing 74 and a second annular groove 76 which receives a seal ring 78 to prevent fluid transfer between the gas chamber 66 and the hydraulic fluid chamber 48. The movement of the actuator 14 toward its retracted position is limited by engagement of an overhanging edge 80 of the retainer 56 with an end or inwardly extending rim 82 of the bearing retainer 34.

Figure 3:
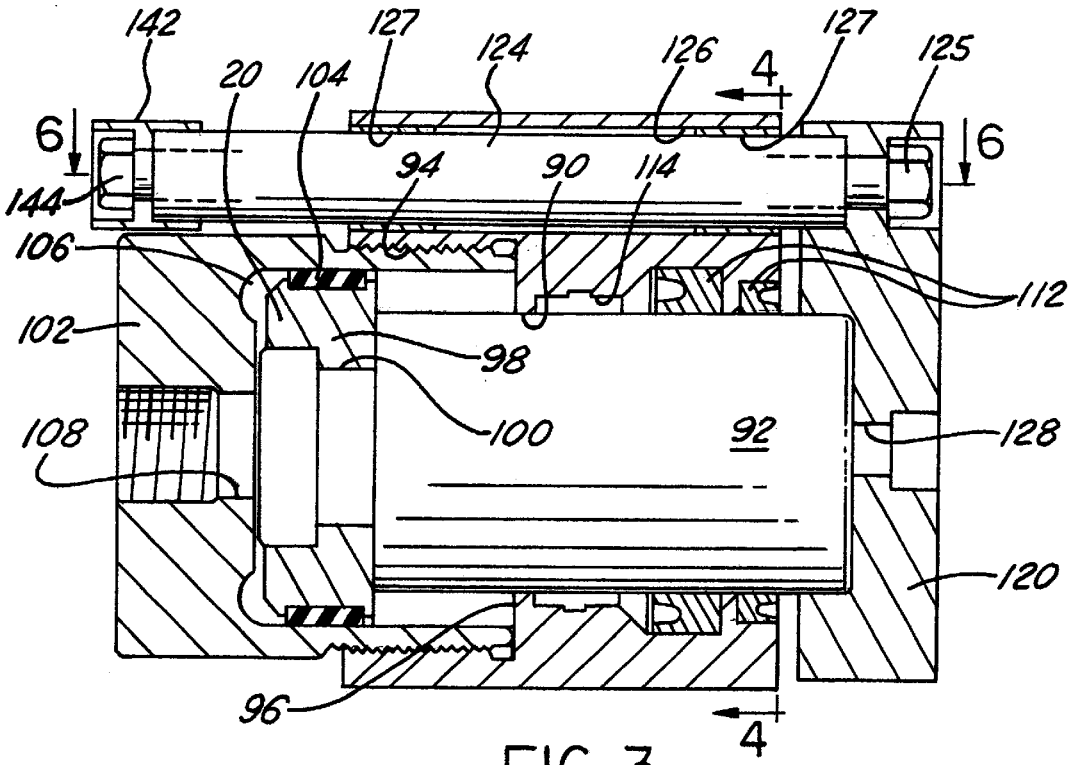
FIG. 3 is a sectional view of the work cylinder of FIG. 1.

As best shown in FIGS. 1 and 3, the work cylinder 18 has a body 84 constructed to be bolted to a base through mounting holes 86 extending through feet 88 of the body 84. The body 84 has a generally cylindrical bore 90 in which a piston rod 92 is slidably received for reciprocation and a counterbore 94 providing a shoulder 96 engageable by the piston 20 which is operably connected to the piston rod 92 to limit the travel of the piston 20 and rod 92.

The piston 20 preferably comprises a split ring having a throughbore and a counterbore providing a rib 98 received in an annular groove 100 in the end of the piston rod 92. The piston 20 is slidably received in a generally cylindrically bore of a cup shaped end cap 102 threadably received in the counterbore 94 of the body 84. The piston 20 preferably carries an annular bearing 104 which guides the piston 20 for reciprocation within the end cap 102. A hydraulic fluid chamber 106 is defined between the piston 20 and end cap 102 and communicates with the hydraulic fluid chamber 48 of the hydraulic actuator 10 through an opening 108 in the end cap 102 and an interconnecting conduit 110.

The work cylinder body 84 carries one or more annular seals 112 which prevent any fluid in a chamber 114 defined between the piston rod 92 and the body 84 from leaking out of the body. Any air or gas in the chamber 114 may be communicated with the atmosphere through a small bleed hole (not shown) which is normally closed.

Figure 4:
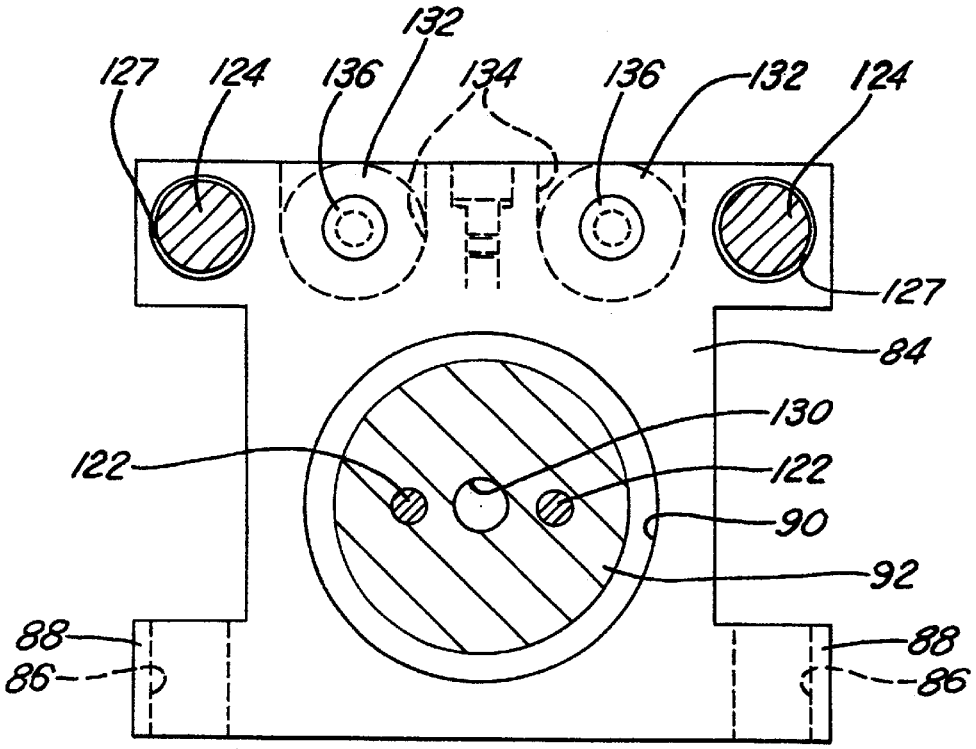
FIG. 4 is a sectional view taken along line 4—4 of FIG. 3.
Figure 5:
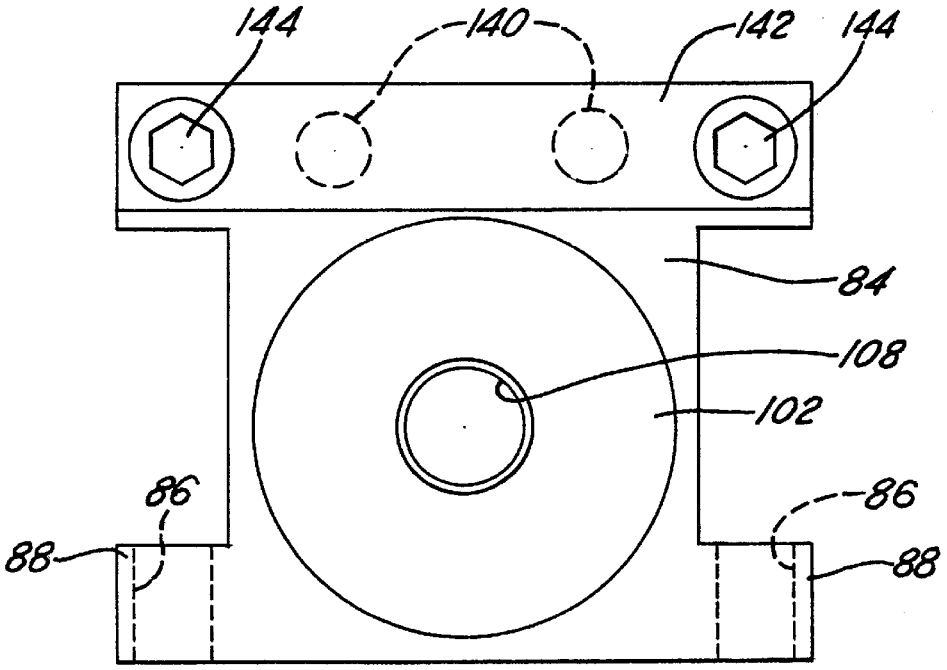
FIG. 5 is an end view of the work cylinder.

A guide plate 120 is fixed to the end of the piston rod extending from the body 84 by a pair of cap screws 122 (FIG. 4) threaded into the piston rod 92. To guide the piston rod 92 for reciprocation, a pair of generally cylindrical rods 124 are connected to the guide plate 120 by cap screws 125 threadably received in the rods 124 and are slidably received in bushings 127 through bores 126 in the body 84. The work tool 12 is preferably threadably received in aligned openings 128, 130 in the guide plate 120 and piston rod 92 for comovement in unison therewith.

Figure 6:
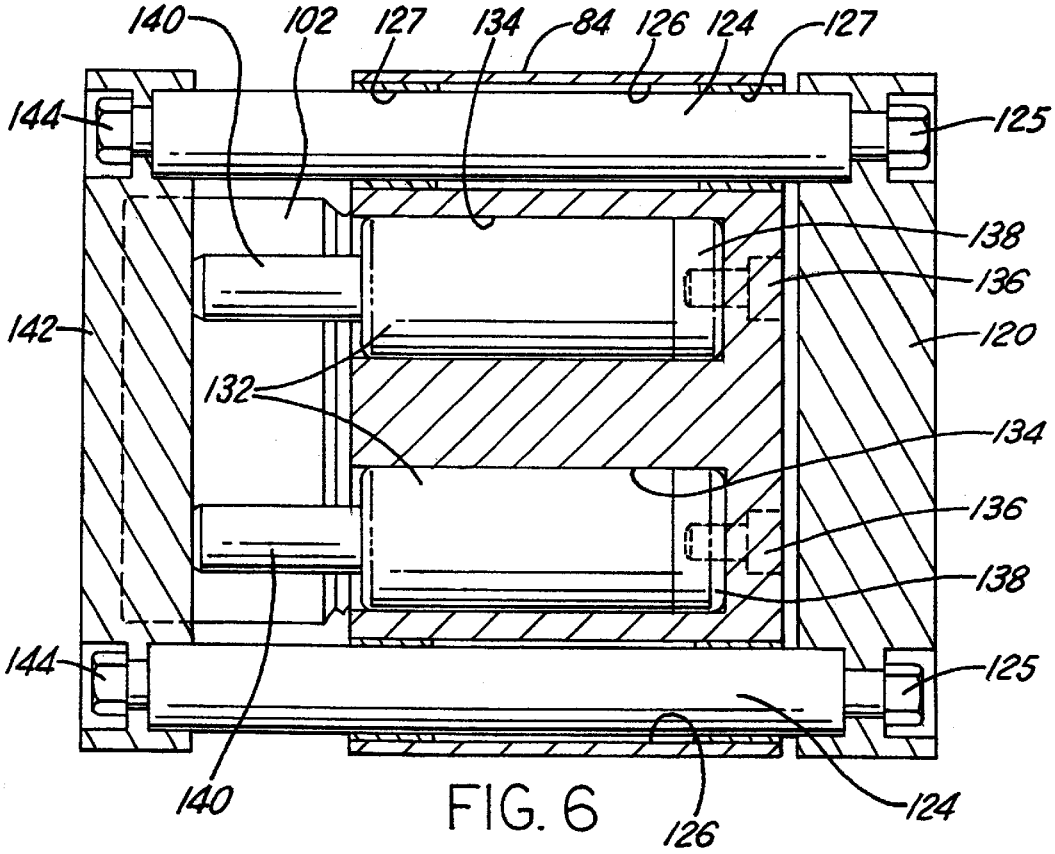
FIG. 6 is a sectional view taken along line 6—6 of FIG. 3.

To yieldably bias the rod 92 and piston 20, as best shown in FIG. 6, gas springs 132 are each received in separate pockets 134 in the body 84 and fixed therein by a cap screw 136 received in a threaded bore in an end cap 138 of each gas spring 132. Each gas spring 132 has a plunger 140 extending out of its pocket 134 and engageable with a bar 142 connected to each leg 124 by a cap screw 144 to yieldably bias the bar 142 and hence, the guide plate 120, piston rod 92 and piston 20 to their retracted positions to minimize the volume of the hydraulic fluid chamber 106 to return the hydraulic fluid to the hydraulic actuator 10 when the actuator 14 is not engaged by the press ram 16. The gas springs 132 may be of substantially any type, such as that disclosed in U.S. Pat. No. 5,303,906, the disclosure of which is incorporated herein by reference in its entirety. Optionally, some other biasing mechanism, such as a coil spring or other mechanical device, may be provided in the pockets to yieldably bias the bar 142 and connected components.

OPERATION

In use, the press ram 16 is advanced to move the actuator 14 from its retracted position to its advanced position to displace the hydraulic fluid from the chamber 48 of the hydraulic actuator 10 to the chamber 106 of the work cylinder 18. The hydraulic fluid in the work cylinder chamber 106 displaces the piston 20 to axially advance the work tool 12. As the piston 20 is advanced, the guide plate 120 is moved away from the body 84 and the bar 142 is moved toward the body 84 and thus bears on and displaces the plungers 140 of the gas springs 132 thereby increasing the pressure of the gas in the gas springs 132. As the press ram 16 is retracted, the plungers 140 of the gas springs 132 displace the bar 142 which, through the rods 124, displaces the guide plate 120 and hence, the rod 92 and piston 20 to decrease the volume of the hydraulic fluid chamber 106 to return hydraulic fluid from the work cylinder 18 to the hydraulic actuator 10. This resets the actuator 14 to its retracted position so that the system is ready for a subsequent cycle.

The piston 68 of the hydraulic actuator 10 is acted on by hydraulic fluid in the chamber 48 on one face and gas in the gas chamber 66 on its other face. Desirably, this permits the system operating pressure to be controlled according to the pressure of the gas in the gas chamber 66. Should the force of the hydraulic fluid acting on the lower face of the piston 68 exceed the force of the gas acting on the upper face of the piston 68, the piston 68 will be slidably displaced within the sleeve 54 thereby relatively increasing the volume of the hydraulic fluid chamber 48 to limit the pressure therein. In one embodiment, the gas chamber 66 may contain a compressed gas, such as nitrogen, at a pressure of 10 to 200 bars (150 to 3000 psi) or more. While the pressure in the gas chamber 66 may increase slightly as the piston 68 is displaced, the system pressure will still be controlled as a function of the gas chamber pressure. In this way, the system operating pressure can be controlled as a direct function of the pressure of the gas in the gas chamber 66. Desirably, the gas chamber pressure can be readily changed as desired for a particular application.

As an alternative, another biasing member, such as a spring, may be provided in chamber 66 and acting on the piston 68. A compression coil spring or belleville spring washers may be utilized. The force of the spring would set the maximum hydraulic fluid pressure in the same manner as the compressed gas described earlier would.

What is claimed is:

1. A hydraulic actuator for at least one hydraulically powered device comprising:

a hydraulic cylinder having a body with a cylindrical bore formed in the body and at least one outlet passage constructed to communicate with a hydraulically powered device;

an actuator sleeve closed at one end and slidably received for reciprocation within the bore of the body between retracted and advanced positions, a piston slidably carried by the sleeve to permit movement between a first position spaced from the closed end of the sleeve and a second position adjacent to the closed end of the sleeve, the piston being yieldably biased towards it first position, a stop carried by the body to retain the actuator sleeve in the body when the actuator sleeve is in its retracted position; and a hydraulic chamber defined between the body and the piston, constructed to contain a hydraulic fluid therein and communicating with the outlet passage whereby when the actuator is moved toward its advanced position, the hydraulic fluid in the hydraulic chamber acts on the piston against its bias and may displace the piston relative to the actuator to thereby limit, at least until the piston reaches its second position, the maximum pressure within the hydraulic chamber.

2. The actuator of claim 1 which also comprises a gas chamber defined between the piston and the sleeve and constructed to receive a pressurized gas to yieldably bias the piston to its first position.

3. The actuator of claim 2 wherein the pressure of gas within the gas chamber is between 10 and 200 bars.

4. The actuator of claim 1 which also comprises a retainer carried by the sleeve and having a rim engageable with the piston to retain the piston at least partially within the sleeve.

5. The actuator of claim 2 wherein the retainer and sleeve have mating threads to connect the retainer to the sleeve.

6. The actuator of claim 1 which also comprises a second retainer carried by the body and having a stop to retain the piston at least partially within the body.

7. The actuator of claim 6 which also comprises a retainer carried by the sleeve and engageable with the stop to retain the piston at least partially within the body.

8. The actuator of claim 1 which also comprises:

a body having a generally cylindrical bore and a stop;

a second piston slidably received for reciprocation within the bore between first and second positions, defining in part a fluid chamber constructed to receive a fluid under pressure from the actuator and engageable with the stop to limit movement of the second piston relative to the body;

a guide plate operably connected to the second piston and yieldably biased to move the second piston to its first position whereby, the second piston is acted on by pressurized fluid in the fluid chamber to move the second piston from its first position to its second position and by the biasing force on the guide plate to move the second piston from its second position to its first position when the biasing force is greater than the force of the fluid in the fluid chamber acting on the second piston.

9. The device of claim 8 which also comprises at least one leg operably connected to the guide plate at one end and to a bar at its other end with said biasing force applied to the bar.

10. The device of claim 9 which also comprises at least one gas spring carried by the body and having a plunger movable between extended and retracted positions, yieldably biased to its extended position and engageable with the bar at least when the second piston is adjacent its second position.

11. The device of claim 9 which also comprises a piston rod slidably received in the body and interconnecting the second piston and the guide plate.

12. A hydraulically powered device, comprising:

a body having a generally cylindrical bore and a stop;

a piston slidably received for reciprocation within the bore between first and second positions, defining in part a fluid chamber constructed to receive a fluid under pressure and engageable with the stop to limit movement of the piston relative to the body;

a guide plate operably connected to the piston and yieldably biased to move the piston to its first position; and at least one rod operably connected to the guide plate at one end and to a bar at its other end with said biasing force applied to the bar, whereby, the piston is acted on by pressurized fluid in the fluid chamber to move the piston from its first position to its second position and by the biasing force on the guide plate to move the piston from its second position to its first position when the biasing force is greater than the force of the fluid in the fluid chamber acting on the piston.

13. The device of claim 12 which also comprises at least one gas spring carried by the body and having a plunger movable between extended and retracted positions, yieldably biased to its extended position and engageable with the bar at least when the piston is adjacent its second position.

14. The device of claim 12 which also comprises a piston rod slidably received in the body and interconnecting the piston and the guide plate.

* * * * *

UNITED STATES PATENT AND TRADEMARK OFFICE

CERTIFICATE OF CORRECTION

PATENT NO. : 6,295,813 B1
DATED : October 2, 2001
INVENTOR(S) : Sven Stenquist

It is certified that error appears in the above-identified patent and that said Letters Patent is hereby corrected as shown below:

Column 5,
Line 24, change "claim 2" to -- claim 4 --.

Signed and Sealed this

Fourteenth Day of May, 2002

*Attest:*

*Attesting Officer*

JAMES E. ROGAN
*Director of the United States Patent and Trademark Office*